US012674336B2

(12) United States Patent
Alhajeh et al.

(10) Patent No.: US 12,674,336 B2
(45) Date of Patent: Jul. 7, 2026

(54) SYSTEM AND METHOD OF SOLAR HARVESTING FOR AQUATIC DEVICES

(71) Applicant: Pentair Water Pool and Spa, Inc., Cary, NC (US)

(72) Inventors: Anas Alhajeh, Clayton, NC (US); Andrew Phy, Apex, NC (US); Jason M. Cowell, Apex, NC (US); James Miller, Sanford, NC (US); Mitchell Bellamy, Sanford, NC (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 245 days.

(21) Appl. No.: 18/397,362

(22) Filed: Dec. 27, 2023

(65) Prior Publication Data

US 2024/0218686 A1 Jul. 4, 2024

Related U.S. Application Data

(60) Provisional application No. 63/477,802, filed on Dec. 29, 2022.

(51) Int. Cl.
*E04H 4/06* (2006.01)
*E04H 4/16* (2006.01)

(52) U.S. Cl.
CPC ..... *E04H 4/06* (2013.01); *E04H 4/16* (2013.01)

(58) Field of Classification Search
CPC ..... E04H 4/06; E04H 4/16
USPC ..... 4/496, 488
See application file for complete search history.

(56) References Cited

U.S. PATENT DOCUMENTS

| | | | | |
|---|---|---|---|---|
| 7,274,975 | B2 * | 9/2007 | Miller | H02J 3/14 700/295 |
| 7,962,249 | B1 * | 6/2011 | Zhang | H02J 3/381 700/297 |
| 8,200,373 | B2 * | 6/2012 | Stiles, Jr. | G06Q 10/06 307/64 |
| 8,227,937 | B2 * | 7/2012 | Barlock | H02J 7/35 307/66 |
| 9,031,702 | B2 * | 5/2015 | Pruchniewski | H04L 41/082 700/282 |
| 9,946,285 | B2 * | 4/2018 | Binding | G05F 1/66 |
| 10,219,975 | B2 * | 3/2019 | Potucek | G08B 25/08 |
| 11,205,900 | B2 * | 12/2021 | Bae | H02M 3/04 |
| 11,720,085 | B2 * | 8/2023 | Roy | G01K 3/005 700/275 |

(Continued)

FOREIGN PATENT DOCUMENTS

| | | | | |
|---|---|---|---|---|
| CN | 106172190 A | * | 12/2016 | A01G 31/00 |
| CN | 108012967 A | * | 5/2018 | A01K 63/042 |

(Continued)

*Primary Examiner* — Lori L Baker
(74) *Attorney, Agent, or Firm* — Husch Blackwell LLP

(57) ABSTRACT

A system and method for monitoring and controlling power for connected aquatic devices includes a power module designed to generate power and transmit the energy to an energy storage module. A controller can be connected to one or more pool components of a connected aquatic system and one or more peripheral devices connected to the pool components. The system can receive and process requests from the pool components and peripheral devices, including low-power notifications, to provide the energy stored in the energy storage module.

20 Claims, 11 Drawing Sheets

(56) References Cited

U.S. PATENT DOCUMENTS

| | | | | |
|---|---|---|---|---|
| 2010/0274408 | A1* | 10/2010 | Stiles, Jr. | G06Q 10/06 700/296 |
| 2013/0201316 | A1* | 8/2013 | Binder | G07C 3/02 701/2 |
| 2014/0314062 | A1* | 10/2014 | Loebs | H04L 12/2816 370/338 |

FOREIGN PATENT DOCUMENTS

| | | | | | |
|---|---|---|---|---|---|
| CN | 107114152 | B | * | 10/2020 | A01K 67/33 |
| CN | 115044475 | A | * | 9/2022 | C12N 1/38 |
| DE | 102019101091 | A1 | * | 7/2019 | H02S 20/30 |
| TW | 201035505 | A | * | 10/2010 | A01G 31/00 |
| UA | 108882 | U | * | 8/2016 | A01G 31/00 |
| WO | WO-2010085491 | A1 | * | 7/2010 | F24D 19/1042 |
| WO | WO-2013053014 | A1 | * | 4/2013 | H02J 13/00006 |
| WO | WO-2014172559 | A1 | * | 10/2014 | H04L 12/283 |
| WO | WO-2016073215 | A1 | * | 5/2016 | G01S 1/0426 |
| WO | WO-2023117885 | A1 | * | 6/2023 | H04W 52/0277 |

* cited by examiner

SYSTEM AND METHOD OF SOLAR HARVESTING FOR AQUATIC DEVICES

CROSS-REFERENCE TO RELATED APPLICATIONS

This application claims priority to U.S. Provisional Application No. 63/477,802 filed on Dec. 29, 2022, the entire disclosure of which is incorporated herein by reference.

BACKGROUND

Many aquatic devices, such as equipment for pools and spas, include peripheral devices, like sensors and lights. Existing pool and spa systems lack the ability to power the peripheral devices without a separate hard-wired power connection, which involves installation time and expense. Additionally, peripheral devices can utilize a different voltage than the aquatic device, which can involve multiple power connections, circuits, and/or additional electrical equipment to accommodate the hard-wired connection of peripheral devices. Some peripheral devices are wireless or battery-powered, which can create a burden on the pool or spa owner to ensure the devices are appropriately powered and/or manually replace the batteries. Existing systems also lack the ability to dynamically integrate using a scalable structure that can be used with a plurality of devices and applications, including automatic control of power harvesting techniques.

SUMMARY

In one aspect, a system for monitoring and controlling power to one or more aspects of a connected aquatic system is provided. The system can include a first system component provided in the form of a pool device and a first peripheral device operatively coupled to the first system component. The system further includes a power module operatively coupled to the first peripheral device and an energy storage module operatively coupled to the power module. The power module is configured to generate and transmit energy to be stored in the energy storage module. The system also includes a controller designed to execute programmable instructions. The programmable instructions include receiving an update from the first peripheral device that indicates a minimum power level of the first peripheral device. The programmable instructions also include providing energy from the energy storage module to the first peripheral device such that the minimum power level is met based on receiving the update.

In some aspects, the power module is provided in the form of a solar energy harvesting system. In some embodiments, the solar energy harvesting system is provided in the form of one or more solar panels and a solar panel controller. In some forms, the power module is provided in the form of a turbine system. The turbine system can be installed within the first system component provided in the form of an aquatic system pump. The turbine system can include an impeller device in some aspects. In some forms, the controller is designed to execute further programmable instructions including receiving an update from the first system component that indicates a minimum power level of the first system component. The controller can also provide energy from the energy storage module to the first system component such that the minimum power level is met based on receiving the update.

In another embodiment, a system for monitoring and controlling power to one or more components of a smart aquatic system is provided. The system includes a system component and a power module designed to collect energy. The power module includes a solar energy harvesting system. The system also includes an energy storage module operatively coupled to the power module. The system further includes a controller designed to execute programmable instructions. The programmable instructions include measuring an amount of energy collected from the solar energy harvesting system. The programable instructions further include determining whether the amount of energy is sufficient to power the system component based on a set point threshold value of the system component. The programmable instructions also include activating the turbine system to collect supplementary energy based on whether the set point threshold value is met. The programmable instructions further include connecting the energy storage module to the power module to receive energy and provide the energy from the energy storage module to the system component.

In some aspects, the solar energy harvesting system is provided in the form of a solar panel cover system. In some forms, the solar energy harvesting system is provided in the form of a solar panel deck system. In some embodiments, the solar energy harvesting system is provided in the form of a solar panel supercapacitor system. In some examples, the solar energy harvesting system is provided in the form of a submerged solar panel system. In some forms, the system can further include a turbine system installed within a second system component provided in the form of an aquatic system pump. In some aspects, the controller is designed to execute programmable instructions including receiving an update from the system component that indicates a minimum power level of the system component. The controller can also be designed to execute programmable instructions including providing energy from the energy storage module to the first system component such that a minimum power level is met, based on receiving the update.

In another aspect, a method for monitoring and controlling power to the one or more components of the smart aquatic system is provided. The method can include providing an aquatic system, the aquatic system comprising one or more system components, one or more peripheral devices, a power module, an energy module operatively coupled to the power module, a controller, a database; and a network. The method can also include activating the power module to harvest energy. The energy storage module can store the energy. The method can also include receiving a request for energy from the one or more system components or the one or more peripheral devices. The method can further include activating the energy storage module to send energy to the corresponding one or more system components or one or more peripheral devices.

In some aspects, the method also includes monitoring one or more operating parameters of the aquatic system. In some forms, monitoring the one or more operating parameters of the aquatic system is performed by the one or more peripheral devices. In some embodiments, the smart aquatic system further comprises a user device and a notification system. In some forms, the notification system can display the one or more operating parameters on the user device. In some aspects, the method further includes receiving user input from the user device to adjust the one or more operating parameters.

DETAILED DESCRIPTION

Figure 1:
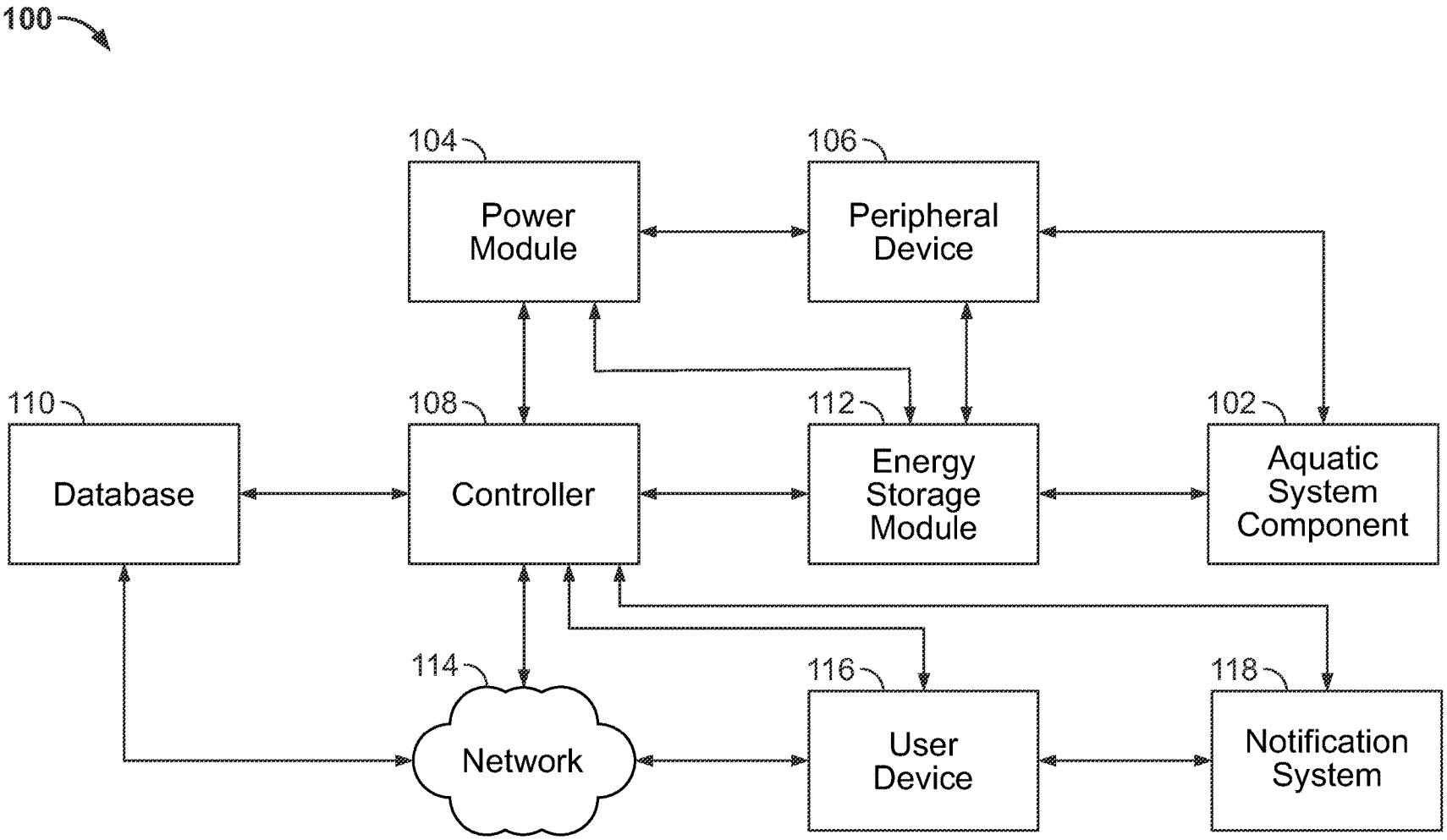
FIG. 1 is a block diagram of a connected aquatic system according to disclosed embodiments.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components outlined in the following description or illustrated in the attached drawings. The invention is capable of other embodiments and of being practiced or of being carried out in various ways. Also, it is to be understood that the phraseology and terminology used herein are for the purpose of description and should not be regarded as limiting. For example, the use of "including," "comprising," or "having" and variations thereof herein is meant to encompass the items listed thereafter and equivalents thereof as well as additional items.

As used herein, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

FIG. 1 illustrates an exemplary connected aquatic system 100 (hereinafter "connected system"), according to disclosed embodiments. When used throughout the disclosure, it will be understood by one skilled in the art that an "aquatic system" can include, for example, any residential aquatic system, like a pool or spa system, or similar. As seen in FIG. 1, the connected system 100 can include one or more aquatic equipment system components 102, a power module 104, one or more peripheral devices 106, a central controller 108, a database 110, an energy storage module 112, and a network 114. The connected system 100 can further include a user device 116 connected to the central controller 108 and/or the network 114. The connected system 100 can further include a notification system 118 designed to generate and transmit notifications to the user device 116 and various aspects of the connected system 100 via the central controller 108.

The one or more aquatic equipment system components 102 (hereinafter "the system components 102") can include any device having a communication port, radio, wired, or wireless communication module. As shown and described in connection with FIG. 2, the system components 102 can include one or more devices utilized for operating and maintaining an aquatic system 250.

The system components 102 can be in communication with other aspects of the connected system 100 to send and receive data sets and can otherwise be connected to provide dynamic monitoring and control of various aspects of the connected system 100. When used throughout the present disclosure, it will be recognized by one skilled in the art that "data sets" can include, but are not limited to, one or more data elements, single variable data, data points, measurements, settings, configurations, parameters, commands, notifications, metrics, readings, similar data component, or any combination of these, or any other information or data.

The power module 104 is designed to collect and/or generate energy to power one or more of the system components 102, peripheral devices 106, other aspects of the connected system 100, or a combination thereof. In some embodiments, the power module 104 uses one or more alternative energy sources to collect and/or generate energy. In some embodiments, the power module 104 can be provided in the form of a power-generating device or a power-generating system. The power-generating device/system can include, but is not limited to line-voltage power, battery power, solar power, hydropower, or any other similar power sources, as well as a hybrid system including one or more of the aforementioned power sources. In a non-limiting example, one embodiment of the power module 104 can be provided in the form of a line-voltage power system with a supplemental power connection to one or more system components 102 utilizing alternative energy source(s). In this embodiment, the alternative power source can be used to generate power for the connected system 100, and the line voltage power can be used when there is not sufficient supplemental power to operate the one or more peripheral devices 106 or system components 102.

In some embodiments, the power module 104 is provided in the form of an inline turbine system 300 to generate power using water flow, as shown and described in connection with FIG. 3A. In some embodiments, the power module 104 is provided in the form of inline impeller system 305 to generate power using water flow, as shown and described in connection with FIGS. 3B and 3C. In some embodiments, the power module 104 is provided in the form of one or more solar panels 210 in combination with a turbine system, such as, but not limited to, the system of FIGS. 3A-3C. In some embodiments, the power module 104 can be provided in the form of a solar panel cover system 400, shown and described in connection with FIG. 4. In some embodiments, the power module 104 can be provided in the form of a solar panel deck system 500, shown and described in connection with FIG. 5. In some embodiments, the power module 104 can be provided in the form of a solar panel supercapacitor system 600, shown and described in connection with FIG. 6. In some embodiments, the power module 104 can be provided in the form of a submerged solar panel system 700, shown and described in connection with FIG. 7. In some embodiments, the power module 104 may be provided in the form of one or more solar panels 210 installed on, integrated with, or otherwise connected to the one or more system components 102. In some embodiments, the power module 104 may be provided in the form of a liner or similar surface covering (e.g., coating) integrated with one or more solar panels 210 for covering one or more surfaces, or a portion of the surfaces, of the aquatic system 250. In some embodiments, the power module 104 may include a combination of one or more of the configurations described herein without departing from the principles of the disclosure.

Returning to FIG. 1, the system components 102 can further include peripheral devices 106 provided in the form of various sensing devices (e.g., flow sensors, chemical sensors, temperature sensors, motion sensors, etc.), battery packs, monitoring devices, dosing devices, cleaning devices, lighting devices, indicators, or any other suitable communication-enabled devices that monitor and/or control the individual system components 102. In some embodiments, the one or more peripheral devices 106 can include low-power devices or other accessories for use within the connected system 100. It will be understood by those having skill in the art that a "sensing device" can include a sensor unit with an individual sensor, a sensor unit with multiple sensors, a single sensor with multiple sensing capabilities, a sensor probe, or a combination thereof.

The central controller 108 can be provided in the form of a data-processing device located proximate to the connected system 100 and designed to transmit and receive data from the system components 102. For example, in some embodiments, the central controller 108 can act as a network interface to create a communication link that operatively connects the system components 102 and the user device 116 over the network 114. In some embodiments, the central controller 108 can transmit notifications via the notification system 118 to the one or more user devices 116. In another embodiment, the system components 102 can also act as a network interface and create a communication link directly to the other system components 102 and the central controller 108. In some embodiments, the central controller 108 can be a gateway, hub, switch, router, server, switch, or other connected devices to allow integration, monitoring, and control of multiple aspects of the connected system 100. The individual system components 102 can likewise be configured to monitor and control the other aspects of the connected system 100.

The database 110 can be provided in the form of a dynamic and scalable data store or other data model that connects or integrates with internal or external systems, databases, data sources, or other platforms from which various data is received or collected. The database 110 may include one or more memory devices, processors, and/or controllers. The database 110 can receive, store, and process data from the system components 102, the power module 104, the one or more peripheral devices 106, the energy storage module 112, and other aspects of the connected system. In some embodiments, the database 110 can extract information according to characteristics, parameters, settings, or similar configurations associated with a single data element or a particular device. For example, a system component 102 and/or a peripheral device 106 can transmit the data set to the central controller 108. The central controller 108 can receive the data set and extract the data according to a characteristic, including but not limited to sensor data, a power status, an activity status, an identification element for the system component 102, user data, usage data, an error code, or other operational parameters relating to any of the system components 102, one or more peripheral devices 106, or other aspects of the system 100. In some embodiments, the extracted data can be transmitted from the central controller 108 and stored in the database 110, lookup table, or similar.

The energy storage module 112 can be provided in the form of a capacitor bank, a battery bank, a rechargeable battery, a solar battery, a supercapacitor, or other energy storage or energy capture devices. In some embodiments, the energy storage module 112 can include a combination of energy capture devices that can be used to support different types of system components 102 and the one or more peripheral devices 106. Additionally, multiple types of energy capture/storage devices may be included in the energy storage module 112 to power different types of aquatic systems, as described in more detail in connection with FIGS. 3A-7. Where used herein, it will be understood that the connected system 100 can include one or more power modules 104 and/or one or more energy storage modules 112, alone or in combination.

The network 114 is located proximate to the system components 102. The network 114 includes, for example, the Internet, intranets, extranets, wide area networks ("WANs"), local area networks ("LANs"), wired networks, wireless networks, cloud networks, or other suitable networks, or any combination of two or more such networks. For example, such networks can include satellite networks, cable networks, Ethernet networks, and other types of networks. In one embodiment, the network 114 is an isolated private network utilizing a private IP address and limiting access to the network. The network 114 can include one or more computing devices that can be arranged, for example, in one or more server banks, computer banks, or other arrangements. Information related to the network 114, including connectivity status, speed, security, connected devices, wireless interface, etc. can be communicated to other aspects of the connected system 100 as a data set.

The system components 102 can interface with the user device 116 either directly over the network 114 using a wired or wireless connection or a connection via the central controller 108. The user device 116 can also interface with the central controller 108 directly or a connection using the network 114. In some embodiments, the central controller 108 can include a control system and/or processing system and interface with the control system and/or processing system via a connection to the network 114 or a connection between one or more of the system components 102.

The user device 116 can be any device capable of connecting to the Internet. In one embodiment, the user device 116 is a portable device like a smartphone or tablet, a computer, or another display interface. The user device 116 can include or is otherwise connected to a programmable processor, a network interface, data capture elements, and a memory unit. In some embodiments, the data capture elements can include a microphone, a camera, a vibration sensor, a similar device, or any combination thereof. The user device 116 can include a Wi-Fi, Bluetooth, cellular, or similar wired or wireless communication link used to communicate with the network 114 and/or the notification system 118. Furthermore, the user device 116 can include program instructions that are stored on a non-transitory computer-readable medium and can be executed by a programmable processor and or the central controller 108 to perform the processes described herein. The user device 116 may be provided in the form of an outdoor control panel, like a poolside or spa-side keypad, in one non-limiting embodiment. It will be appreciated by one skilled in the art that where used herein, the user device 116 can include one or more user devices.

The notification system 118 can be connected to the user device 116 and/or the central controller 108 to generate, transmit, and receive alerts or notifications related to the operation, functionality, and maintenance of the system components 102, the power module 104, and other aspects of the connected system 100. The notification system 118 can also be used to send information to the third-party applications and to generate reports. In some embodiments, the notification system 118 is designed to receive data sets and generate notifications for any of the subcomponents of the connected system 100 (e.g., the system components 102, the peripheral devices 106, the energy storage module 112, etc.). In some embodiments, the central controller 108 may function as a communication link between the notification system 118 and the user device 116 (or other aspects of the connected system 100).

For example, information related to the usage of the power module 104 can be processed and used to generate an energy savings report or a report with customized recommendations to reduce power consumption. The generated energy savings report can be transmitted to the user device 116 and used by third parties to evaluate local rebate programs or to provide customized recommendations for equipment upgrades or updates to configuration settings. As another example, the notification system 118 can be configured to generate and transmit alerts and notifications to a user device 116 when a particular system component 102 or peripheral device 106 is placed in low power mode or requires a battery back-up, or the connected system 100 is otherwise using supplemental power from the power module 104 and/or the energy storage module 112.

Additionally, the system components 102 of the connected system 100 can also communicate directly with one another using a network interface, local network, or any other suitable communication connection. In some embodiments, the communication connection is provided in the form of a wireless module integrated with or otherwise coupled to the system components 102. One skilled in the art will recognize that a communication connection can include, for example, a connection that can transmit and receive data using a communication protocol. Non-limiting examples of the communication connection include wired, wireless, Bluetooth, cellular, satellite, GPS, RS-485, RF, MODBUS, CAN, CANBUS, DeviceNet, ControlNet, Ethernet TCP/IP, RS-232, Universal Serial Bus (USB), Firewire, Thread, proprietary protocol(s), or other known communication protocol(s) as applicable. In some embodiments, the communication connection can be used to passively monitor a power level of a system component 102 and/or a peripheral device 106.

Figure 2:
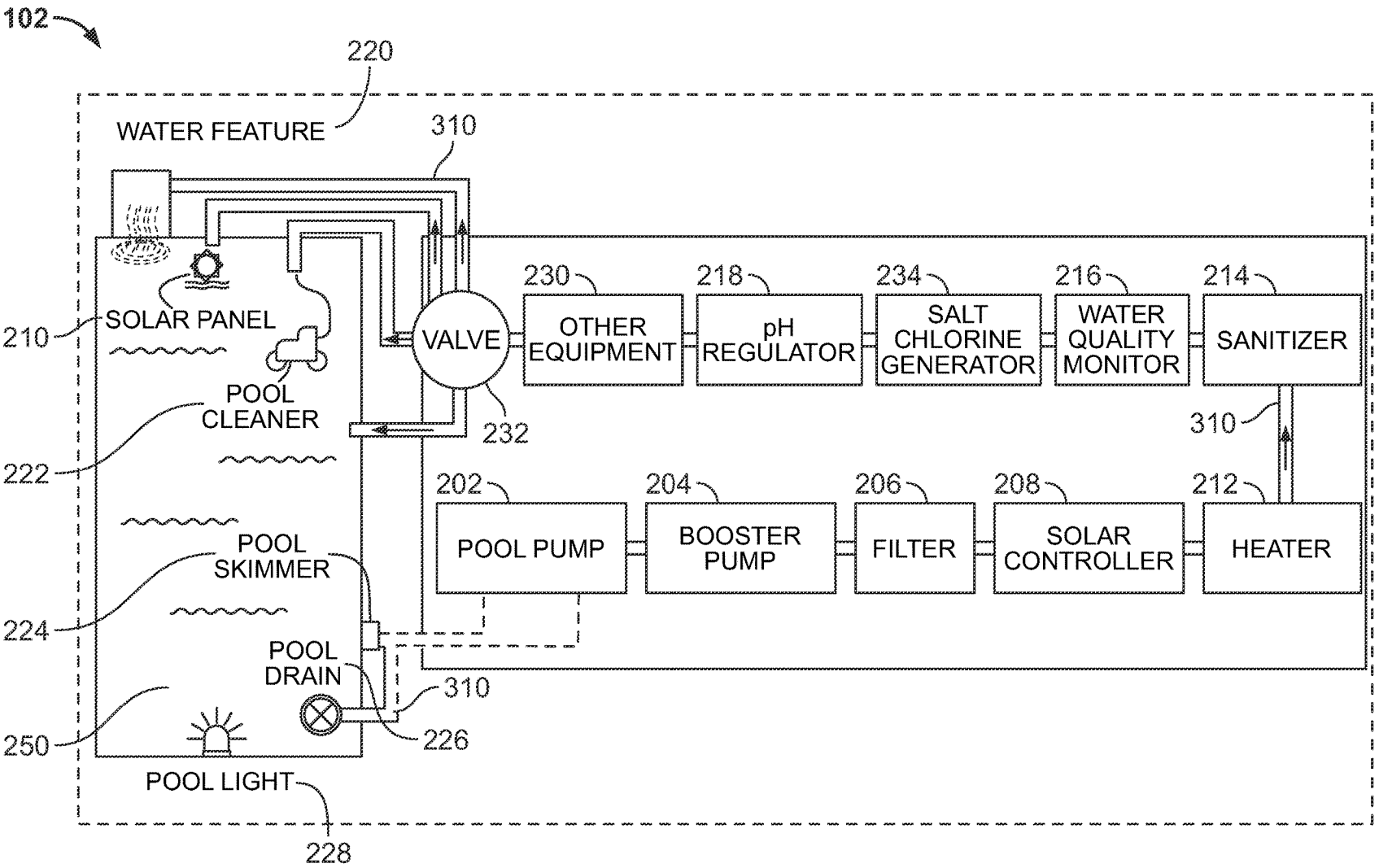
FIG. 2 is a block diagram of system components of the connected aquatic system of FIG. 1 according to disclosed embodiments.

FIG. 2 illustrates an example of the one or more system components 102 that comprise an exemplary aspect of a connected system 100, according to disclosed embodiments. The system components 102 are provided in communication with each other and with the aquatic system 250 to form a fluid circuit 310. The fluid circuit 310 facilitates water movement through the aquatic system 250 and system components 102 to accomplish various tasks including, but not limited to, pumping, cleaning, heating, sanitizing, lighting, and any other similar tasks. In some embodiments, the fluid circuit 310 can include piping or any other similar structures to direct water flow through the connected system 100. In some embodiments, at least some portions of the system components 102 (e.g., electrical components, such as wires, internal circuitry, etc.) may be waterproofed, covered, coated, arranged, or otherwise protected from water damage. Additional arrangements of the connected system 100 besides those shown in FIGS. 1 and 2 are also contemplated.

As seen in FIG. 2, the system components 102 can include one or more of the following devices utilized for operating and maintaining a residential aquatic system like a pool or spa: a pool pump 202, a booster pump 204, a filter 206, a solar controller 208, one or more solar panels 210, a heater 212, a sanitizer 214, a water quality monitor 216, a pH regulator 218, a water feature 220, a pool cleaner 222, a pool skimmer 224, a pool drain 226, a pool light 228, a salt/chlorine generator 234, and other equipment 230. The system components 102 can further include one or more valves 232 to control water flow through the aquatic system 250 and/or the system components 102. The one or more valves 232 can be controlled manually or remotely via the user device 116, the central controller 108, individual system components 102, or any combination thereof. In some embodiments, the other equipment 230 can include at least an intelligent automation system, inverters, chemical monitoring/dosing devices, dosing pumps, and/or lighting devices, or similar component(s).

Each of the system components 102 can further include one or more peripheral devices 106 or other similar sensing devices (see FIG. 1). The one or more peripheral devices 106 can be provided in the form of an integrated sensor, an external sensor, a sensing unit coupled to or in communication with the system component 102, or any suitable combination thereof. In several embodiments, a peripheral device 106 integrated with or removably attached to one or more of the one or more system components 102 is designed to monitor the health, status, operating parameters, and diagnostic values of the system components 102. The peripheral device 106 can include different types of sensing components with one or more of the same type of sensing component. The peripheral device 106 can collect one or more data sets from the system component 102 by placing the peripheral device 106 in more than one location based on a diagnostics aspect of the system component 102. Multiple peripheral devices 106 can be installed based on the size, specifications, and complexity of the connected system 100. The peripheral device 106 can comprise one or more of a power sensor, temperature sensor, pressure sensor, gyro, accelerometer, vibration sensor, flow sensor, current sensor, voltage sensor, power sensor, frequency sensor, energy sensor, fault sensor, audio sensor, optic sensor, or any combination thereof. Moreover, the peripheral device 106 can be configured to collect one or more data sets from the one or more system components 102, or in some examples, the peripheral device 106 may collect data from several of the system components 102. In this non-limiting example, the peripheral device 106 can be provided in the form of a device with several sensing components to collect operating parameters and send one or more data sets including the operating parameters to the central controller 108 and/or the database 110. The central controller 108 and/or the database 110 can process the data sets provided by the peripheral device 106, according to the processes described below.

As a non-limiting example, the pool pump 202 and/or booster pump 204 may include one or more peripheral devices 106 that can be designed to detect power, vibration, current, flow, pressure, temperature, frequency, or a combination thereof. The power sensor can measure whether or not the pool pump 202 and/or booster pump 204 is connected to power, and/or whether it is activated. Additionally, some pool pumps and booster pumps have a soft start mode or similar controlled or reduced power mode, which can be measured and detected by the power sensor. The vibration sensor can measure vibration levels to identify electromagnetic or mechanical imbalance, loose components, rubbing parts, part failure, cavitation, or resonance. Some embodiments may further include an accelerometer to detect if the pump becomes unlevel. The current sensor can measure current flowing through the system using a non-intrusive method. The flow sensor can measure a flow of water that is pumped by a motor of the pool pump 202 and/or booster pump 204 and determines the actual health of the motor by determining if the flow rate is unexpectedly high or low based on the particular application and several threshold metrics. The flow sensor can also include a flow switch and/or a fluid velocity sensor to detect abnormal flow rates. The pressure sensor may monitor pressure in air compressors, irrigation systems, and heat exchangers that all use pumps to push air or water through their respective systems. The pressure sensor may further measure an input and differential pressure at the head of the pool pump 202 and/or booster pump 204. The one or more peripheral devices 106 help to overcome the faults and monitor the pool pump 202 and/or booster pump 204. Further, the temperature sensor monitors the temperature and helps to detect any abnormal temperature rise due to any malfunction or failure, which can include but is not limited to temperature measurements at the inlet, outlet, and motor. The frequency sensor can measure the frequency of the pool pump 202 and/or the booster pump 204 and can be used for controlling VFDs that may be associated with or connected to either the pool pump 202 and/or booster pump 204. In some embodiments, an encoder may be used to measure and/or monitor the velocity of a rotor/impeller of the pool pump 202 and/or booster pump 204. Other sensors such as the voltage sensor can also monitor the input voltage and calculate the power factor of a motor of the pool pump 202 and/or the booster pump 204 using both current and voltage values of the connected system 100 and/or the values detected by the one or more peripheral devices 106 connected to each of the pool pump 202 and/or the booster pump 204.

In another non-limiting example, the filter 206 may include one or more peripheral devices 106 that can be designed to detect pressure, flow, fluid velocity, or a combination thereof. The pressure sensor can detect and monitor differential pressure to identify when the filter may be dirty or clogged with debris. Routine maintenance alerts can be provided to regularly clean the filter 206 and extend the life of the filter 206. The flow sensor may include a flow switch and/or a fluid velocity sensor to measure the flow status and flow rate at the inlet, outlet, and backwash ports of the filter 206. Additionally, the flow sensor can measure the flow rate to help detect potential leaks in the filter 206 and in the filter compartment (not shown).

The one or more solar panels 210 can be provided in the form of one or more solar harvesting devices. When used throughout the present disclosure, it will be recognized by one skilled in the art that "solar panels" can include, but are not limited to, one or more individual glass solar panels, crystalline solar panels, organic/plastic solar panels, hybrid solar panels, an array of multiple solar panels, a flexible solar panel/film, a solar cell coating, or other device or system designed to capture and collect solar energy. The one or more solar panels 210 can be wireless, wired, or a combination of both configurations. Additionally, arrangements of the one or more solar panels 210 described herein can include multiple sizes, types, and materials of panels. In some embodiments, the one or more solar panels 210 may be waterproofed according to known techniques and forms in the art (e.g., amorphous silicon solar cells coated with polydimethylsiloxane (PDMS)).

The one or more solar panels 210 also include control system wiring, power cables, mounting hardware, and other hardware and software components other than those described herein. In some embodiments, advanced wiring techniques may be used so that the connections to the solar panels 210 are not visible. Some aspects of the control and power wiring to the one or more solar panels 210 can be eliminated by using wireless technologies.

In some embodiments, the individual system components 102 can include one or more integrated solar panels 210. Non-limiting examples of solar panels 210 integrated with system components 102 can include one or more solar panels 210 installed on a portion of a pool pump 202, a booster pump 204, a filter 206, a heater 212, a solar controller 208, a sanitizer 214, a water quality monitor 216, a salt/chlorine generator 234, a pH regulator 218, one or more valves 232, a water feature 220, a pool cleaner 222, a pool skimmer 224, a pool light 228, a pool drain 226, etc. In some embodiments, the integrated solar panels 210 can be provided in the form of plug-and-play or other add-on solar panels 210. In at least this way, one or more peripheral devices 106 can be retrofitted to existing system components 102.

In some embodiments, the solar panels 210 can be sized, designed, or otherwise configured based on the specifications and/or usage patterns of the individual system component(s) 102. In one non-limiting example, the water quality monitor 216 can be provided with one or more solar panels 210. In this example, the water quality monitor 216 has an average daily energy consumption of approximately 72.5 mWh (e.g., 18.58 mAh), which can be supplied by the one or more solar panels 210. The one or more solar panels can be sized approximately 6.5 $cm^2$ (e.g., 2.5 cm×2.5 cm) to supply the amount of power needed for the water quality monitor 216. The water quality monitor 216, assuming 24 hours of use, can consume approximately 5000 mAh provided by the one or more solar panels 210 over approximately 270 days. The one or more solar panels 210 can produce approximately 160 $\mu Wh/mm^2$ per day; wherein approximately 33.32 $\mu W/mm^2$ is produced with 3 hours of direct sunlight a day, approximately 6.66 $\mu W/mm^2$ is produced with 9 hours of indirect sunlight a day (e.g., shady or overcast conditions), and no energy is harvested during 12 hours of nighttime. In some aspects, the one or more solar panels 210 can have approximately 70% PMIC efficiency, and thus effectively produce approximately 112 $\mu Wh/mm^2$ of available energy per day. It will be appreciated by one skilled in the art that other power generation outputs, consumption rates, and efficiency configurations are contemplated.

High-powered system components (e.g., those having larger power demand, such as the heater 212, the pool pump 202, other equipment 230, etc.) may be provided with an array of one or more solar panels 210 and an energy storage module 112 (e.g., a high voltage battery, supercapacitor, etc.). In some embodiments, multiple high-power devices may share an energy storage module 112 and/or a set of solar panels 210. In some embodiments, low-powered system components (e.g., those having smaller power demand, such as one or more peripheral devices 106, other equipment 230, etc.) may each be provided with one or more solar panels 210 and an energy storage module 112 (e.g., a battery pack, a single battery, and/or a supercapacitor, etc.). In some embodiments, medium-powered system components 102 (e.g., energy storage module 112, salt/chlorine generator 234, other equipment 230, etc.) can be charged by one or more solar panels 210 and then discharged over a predetermined amount of time (e.g., overnight).

In another non-limiting example, the one or more solar panels 210 can include one or more peripheral devices 106 that can be designed to detect power, voltage, current, solar radiation, or a combination thereof. The power sensor can measure whether or not the one or more solar panels 210 are activated. The voltage and current sensors can be used to detect the power generation of the one or more solar panels 210. In addition to the data analytics techniques described herein, these measurements can be used to produce energy reports and historical usage data that can be displayed on the user device 116. A photosensor can be used to detect levels of solar radiation (e.g., whether it is a sunny day or a cloudy day).

The solar controller 208 can be provided in the form of a solar energy harvesting power management unit, or a similar controller device. In some embodiments, the solar controller 208 and the central controller 108 can be integrated as a single device, including a controlling device with one or more subassemblies designed to perform one or more tasks or functions of the connected system 100. In some embodiments, the solar controller 208 can be a standalone plug-and-play device designed to cooperate with one or more solar panel system manufacturers and/or devices. The solar controller 208 can be designed to activate and deactivate the power module 104, control and manage energy collection, and transform collected energy to prepare for storage in the energy storage module 112.

The solar controller 208 can be designed to monitor the power level of the one or more peripheral devices 106 and the system components 102. The solar controller 208 can use a microcontroller configured to execute logic functions to control the shutdown and power source of the one or more peripheral devices 106 and the system components 102. For example, the solar controller 208 can communicate with a peripheral device 106 associated with a particular system component 102 (e.g., a flow sensor on the pool pump 202) to determine if the particular system component 102 has a low battery charge, has lost line power, or a similar power shortage scenario. The solar controller 208 can execute a logic function to power off the particular system component 102 or place it in a low-power mode to reduce power consumption. The solar controller 208 can also send a request and/or generate a command signal to trigger the particular system component 102 to receive power from the energy storage module 112. In some embodiments, this operation may include the use of a battery backup or supplemental power from a solar panel 210. For high-powered devices and system components 102, the solar controller 208 may be integrated with a large roof-mounted solar array, like the solar panel supercapacitor system 600 described in connection with FIG. 6.

In another non-limiting example, the solar controller 208 may include one or more peripheral devices 106 that can be designed to detect voltage, current, temperature, or a combination thereof. The power sensor can measure whether or not the solar controller 208 is connected to power, and/or whether it is activated. The voltage sensor can monitor the input voltage and detect any upstream electrical system faults. The voltage sensor can also measure the control voltage and verify the output signal to a solar valve actuator is within a functional range (e.g., ~0-24V), and can verify the solar controller 208 relay voltage is within a functional range (e.g., ~0-230 VAC). The temperature sensor can be used to monitor an internal temperature of the solar controller 208 and identify if any internal components, including electronic components, are overheating.

In another non-limiting example, the heater 212 may include one or more peripheral devices 106 that can be designed to detect power, voltage, current, temperature, pressure, or a combination thereof. The power sensor can measure whether or not the heater 212 is connected to power, and/or whether it is activated. The voltage sensor can monitor the input voltage and detect any upstream electrical system faults. The voltage sensor can also measure voltage drop to determine the power consumption of the heater 212. The current sensor can detect potential short circuits in the heater 212 by identifying abnormal power consumption and/or current spikes. The temperature sensor can be used to monitor the internal temperature of the heater 212 including the heating elements (not shown). The temperature sensor can also measure the temperature at an inlet and an outlet to verify the water temperature is being heated according to the heater 212 controls and settings. The pressure sensor can measure a differential pressure to identify scale or fouling through a water passage in the heater 212.

In another non-limiting example, the sanitizer 214 may include one or more peripheral devices 106 that can be designed to detect power, radiant energy, resistance, voltage, current, pressure, or a combination thereof. The power sensor can measure whether or not the sanitizer 214 is connected to power, and/or whether it is activated. In some embodiments, the sanitizer 214 is an Ultraviolet (UV) Light sanitizing device and a photosensor can be used to measure the radiant energy of the sanitizer 214 to also determine if the sanitizer is activated. The resistance sensor can determine the electrical resistance across the UV bulb to verify the bulb is properly installed and within a functional range. Irregular resistance measurements can indicate a replacement bulb is recommended for the sanitizer 214. The voltage sensor can monitor an input voltage and detect any upstream electrical system faults. The voltage sensor can also measure voltage drop to determine the power consumption of the sanitizer 214. The current sensor can measure the current in the sanitizer 214 system to verify the circuit is working properly. Low or non-existent current measurements may indicate a replacement bulb is recommended for the sanitizer 214. The pressure sensor measures a differential pressure to detect scale or fouling through a water passage in the sanitizer 214.

In another non-limiting example, the water quality monitor 216 may include one or more peripheral devices 106 that can be designed to detect power, voltage, flow, resistance, water chemistry, or a combination thereof. The power sensor can measure whether or not the water quality monitor 216 is connected to power, and/or whether it is activated. The voltage sensor can monitor the input voltage and detect any upstream electrical system faults. The voltage sensor can also measure a battery level if the water quality monitor 216 is battery-powered or includes a battery pack. The flow sensor can also include a flow switch and can monitor water flow at an input and/or an output of the water quality monitor 216 and can identify potential clogs in the monitoring system. The flow sensor can further determine if the flow velocity is sufficient for proper operating conditions for the water quality monitor 216.

In another non-limiting example, the pH regulator 218 may include one or more peripheral devices 106 that can be designed to detect power, voltage, current, level, chemistry, flow, or a combination thereof. The power sensor can measure whether or not the pH regulator 218 is connected to power, and/or whether it is activated. The voltage sensor can monitor the input voltage and detect any upstream electrical system faults. The current sensor can measure the current in the pH regulator 218 system to verify the circuit is working properly. Abnormal current measurements and/or an abnormal power consumption reading may indicate a malfunction. A chemical tank level associated with the pH regulator 218 can be measured by a level sensor, such as but not limited to a float switch, force sensor, or similar. The chemical sensor can be used to identify chemical properties within the chemical tank. In some embodiments, one or more electrodes, or similar, may be used to measure a difference in the electrical potential between a pH electrode and a reference electrode. The flow sensor can include a flow switch and/or a fluid velocity sensor to measure a rate at which chemicals are dispensed through the pH regulator 218 system. In some embodiments, the flow sensor may also be integrated with, or otherwise communicate with, the chemical sensor to measure the type and quantity of chemical(s) dispensed. In some embodiments, an encoder may be used to measure, monitor, and/or detect the rotational position and velocity of a dispensing component of the pH regulator 218.

In another non-limiting example, the water feature 220 may include one or more peripheral devices 106 that can be designed to detect power, flow, pressure, or a combination thereof. The power sensor can measure whether or not the water feature 220 is connected to power, and/or whether it is activated. The flow sensor can include a flow switch and/or fluid velocity sensor, or similar, to measure the fluid/water flow rate through the water feature 220. The pressure sensor can be used to detect a water depth at a bottom surface of the water feature 220. The pressure sensor may also communicate with the flow sensor to measure the flow rate through the water feature 220.

In another non-limiting example, the pool cleaner 222 may include one or more peripheral devices 106 that can be designed to detect power, voltage, pressure, if debris should be emptied from the pool cleaner 222, or a combination thereof. The power sensor can measure whether or not the pool cleaner 222 is connected to power, and/or whether it is activated. The voltage sensor can monitor the input voltage and detect any upstream electrical system faults. The pressure sensor can measure a suction level in a suction line of the pool cleaner 222. An encoder can be used to detect if the one or more spinning motors of the pool cleaner 222 are rotating properly. As with the other system components 102 described herein, the monitored measurements may vary depending on the manufacturer and type of the pool cleaner 222.

In another non-limiting example, the pool skimmer 224 may include one or more peripheral devices 106 that can be designed to detect pressure. A differential pressure sensor can detect if there is a clog in a skimmer basket of the pool skimmer 224 or if debris is interfering with air being induced in an equalizer line of the pool skimmer 224. In some embodiments, an encoder may be used to detect a position of a weir installed in the pool skimmer 224.

In another non-limiting example, the pool drain 226 may include one or more peripheral devices 106 that can be designed to detect temperature, flow, pressure, or a combination thereof. The temperature sensor can measure the temperature of the water output flowing through the pool drain 226. The flow sensor may include a flow switch and/or fluid velocity sensor, or similar, to measure the flow rate of water through the pool drain 226. The pressure sensor may measure a pool water level. The pressure sensor can also measure a differential pressure to detect if the pool drain 226 may be clogged.

In another non-limiting example, the pool light 228 can include one or more peripheral devices 106 that can be designed to detect power, voltage, current, temperature, resistance, or a combination thereof. The power sensor can measure whether or not the pool light 228 is connected to power, and/or whether it is activated. The voltage sensor can measure the input voltage to the pool light 228 and detect any upstream electrical system faults. The current sensor can measure the current through the pool light 228 and can be used with the voltage sensor to measure power consumption. The voltage and/or current sensor can also detect when there is an abnormal power consumption measurement, which may indicate a malfunction with the pool light 228. In some embodiments, the pool light 228 may include one or more pool lights and can also include advanced lighting controls such as animation, color, dimming, timer controls, etc. The advanced lighting control features for the pool light 228 can include one or more peripheral devices 106 to detect and measure system variables and/or operating parameters associated with the one or more lighting control features. In some embodiments, the resistance can also be measured to identify electrical shorts, faults, or when a light bulb or diode should be replaced.

In another non-limiting example, the other equipment 230 may include one or more peripheral devices 106 that can be designed to detect one or more operating parameters associated with components of the other equipment 230 (e.g., power status, operational mode, flow, pressure, chemical composition, calibration status, and other parameters).

In another non-limiting example, the one or more valves 232 may include one or more peripheral devices 106 that can be designed to detect voltage, current, position, flow, or a combination thereof. The voltage sensor can monitor the input voltage and detect any upstream electrical system faults. The voltage sensor can also measure the control voltage and verify the output signal to a valve 232 actuator is within a functional range (e.g., ~0-24V). The current sensor can measure the current in the one or more valves 232 and detect if there is an abnormal current measurement. Abnormal current measurements and/or an abnormal power consumption reading may indicate a malfunction in the valve 232. The position of a valve 232 actuator and/or shaft can be detected using a position sensor, encoder, or similar. The flow switch can measure the flow rate through the one or more valves 232 and detect if a valve port is not receiving an expected flow.

In another non-limiting example, the salt chlorine generator 234 may include one or more peripheral devices 106 that can be designed to detect power, voltage, flow, resistance, water chemistry, or a combination thereof. The power sensor can measure whether or not the salt chlorine generator 234 is connected to power, and/or whether it is activated. The voltage sensor can monitor the input voltage and detect any upstream electrical system faults. The voltage sensor can also measure a battery level if the salt chlorine generator 234 is battery-powered or includes a battery pack. The flow sensor can also include a flow switch and can monitor water flow at an input and/or an output of the salt chlorine generator 234 and can identify potential clogs in the system. The flow sensor can further determine if the flow velocity is sufficient for proper operating conditions for the salt chlorine generator 234.

Figure 3A:
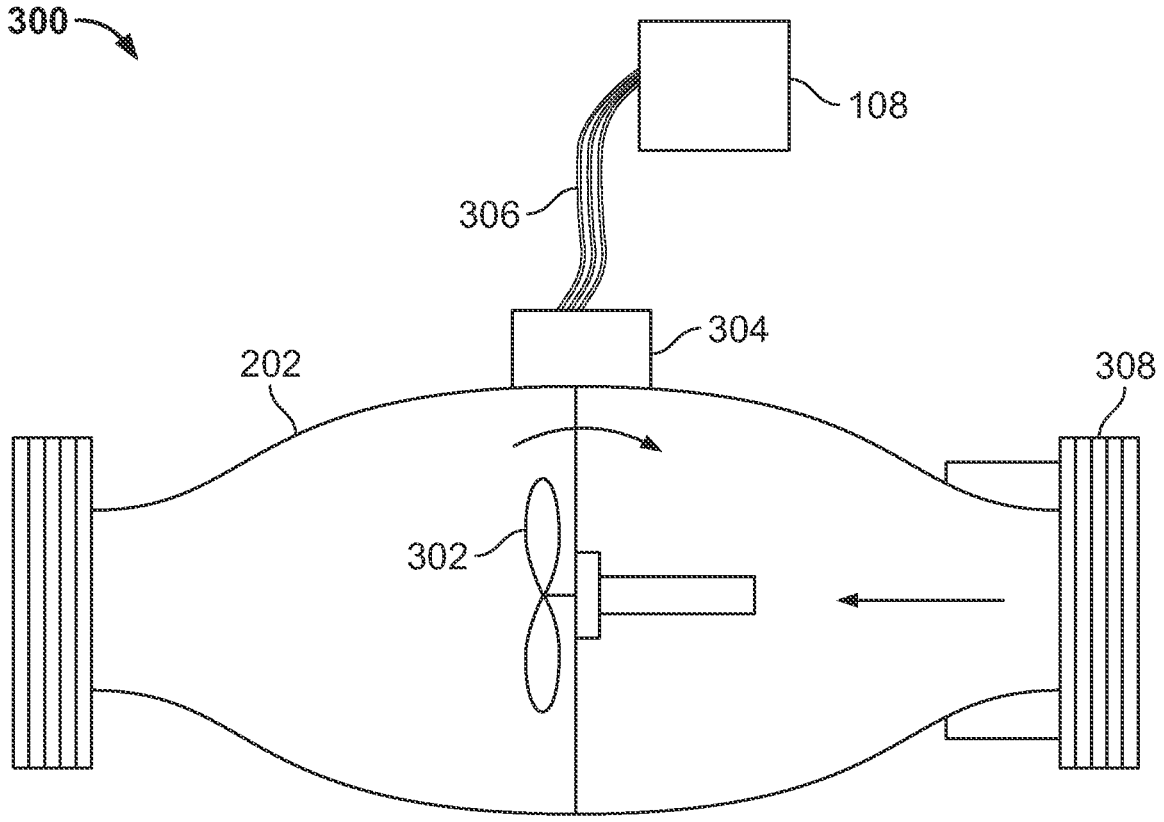
FIG. 3A is a side elevation view of an embodiment of the power module of the connected aquatic system of FIG. 1 according to disclosed embodiments.

FIG. 3A illustrates one embodiment of the power module 104 provided in the form of the inline turbine system 300 installed in the fluid circuit 310 of the pool pad (see FIG. 2, where the fluid circuit 310 is provided in the form of the plumbing system). In one aspect, the inline turbine system 300 may be installed in connection with the pool pump 202 (as shown) or booster pump 204 to generate power using water flow. It will be understood that the pool pump 202 example shown in FIG. 3A is non-limiting. In at least this way, the inline turbine system 300 collects the energy generated from an impeller 302 of the pool pump 202 based on the water flow therethrough using a motor. In some embodiments, the inline turbine system 300 may include a connection to potting 304 or other components. In some aspects, the inline turbine system 300 can be communicatively coupled to the controller 108 using system control wiring 306. In some embodiments, the connection to the controller 108 can be wireless. In some embodiments, the inline turbine system 300 can be operatively coupled to the energy storage module 112. In some embodiments, the controller 108 shown in FIG. 3A can be provided in the form of the solar controller 208. The connector 308 can be provided in the form of a 2" male union, although other sizes and connection configurations can be utilized.

In some embodiments, the impeller 302 can be provided in the form of a power generator, while in other embodiments, the impeller 302 can be provided in the form of a flow sensor or flow meter. In one non-limiting example, the impeller 302 can include a paddle wheel to generate power by connecting the paddle wheel to a motor and/or generator and an encoder to count paddle wheel revolutions per minute. In some forms, water flow can be calculated based on input from the encoder and other operating metrics (e.g., pipe size, pipe material, water quality parameters, etc.).

Figure 3B:
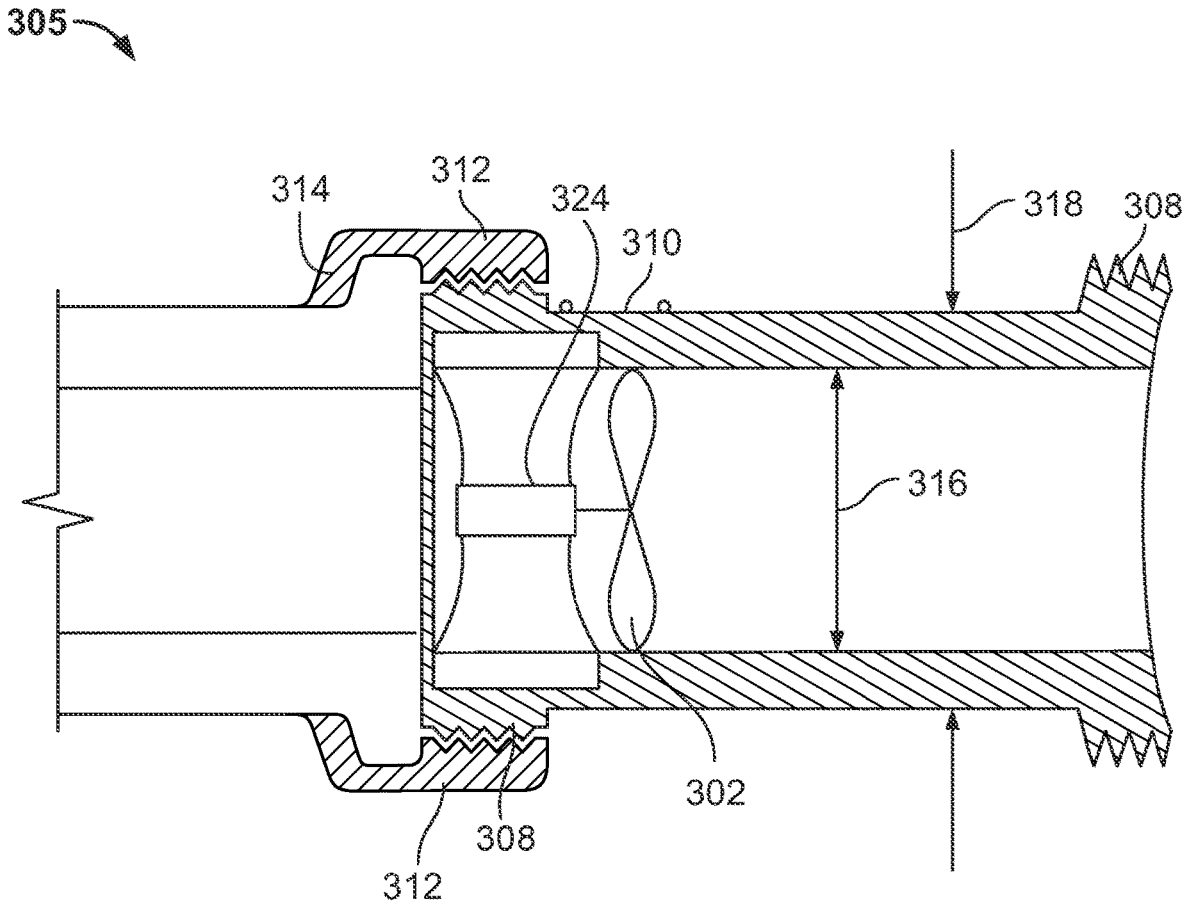
FIG. 3B is a partial cross-section view of an embodiment of the power module of the connected aquatic system of FIG. 1 according to disclosed embodiments.

FIG. 3B illustrates one embodiment of the power module 104 provided in the form of an inline impeller system 305. Similar to the inline turbine system 300 described in connection with FIG. 3A, the inline impeller system 305 includes an impeller 302 to generate power using water flow. However, rather than being installed inside the pool pump 202, the inline impeller system 305 is provided in the form of an axial flow pump that turns the impeller 302 in line with the flow of water in the fluid circuit 310 of the connected system 100. The collected energy can be directed to the controller 108 to transform the power to be stored in the energy storage module 112 or directly used by one or more low-voltage devices, like the peripheral devices 106. In some embodiments, the power transformation can be performed by an inverter, or a similar power converter or filter of the energy storage module 112.

In some embodiments, the inline impeller system 305 can be triggered by a flow sensor 324 that detects when adequate water is flowing through the fluid circuit 310. In some embodiments, the flow sensor 324 can be provided in the form of a reed switch and a magnet embedded in a plunger. The plunger and the magnet can be located in a position relative to a printed circuit board assembly (PCBA) mounted reed switch. The reed switch closes when there is water flow and opens the reed switch when there is no water flow, due to the presence of magnetic flux. In at least this way, the inline impeller system 305 is activated or in an "awake" mode when there is water flow and is otherwise not activated or in a "sleep mode" when there is no water flow.

Other aspects of the connected system, including other embodiments of the system 305 can be similarly activated and/or be provided in the form of a system with an "awake" mode, "sleep" mode, and other modes. In other embodiments, the inline impeller system 305 can be triggered by a thermal camera, a motion detector, etc.

The inner pipe diameter dimension 316 can be approximately 2" in some embodiments and the outer pipe diameter dimension 318 can be approximately 2.375", although any other suitable pipe diameters can be provided with the inline impeller system 305. In some embodiments, the fluid circuit 310 can include an outer wall of 2" diameter schedule 40 PVC pipe, although any other suitable pipe sizes and materials can be used in some aspects.

Figure 3C:
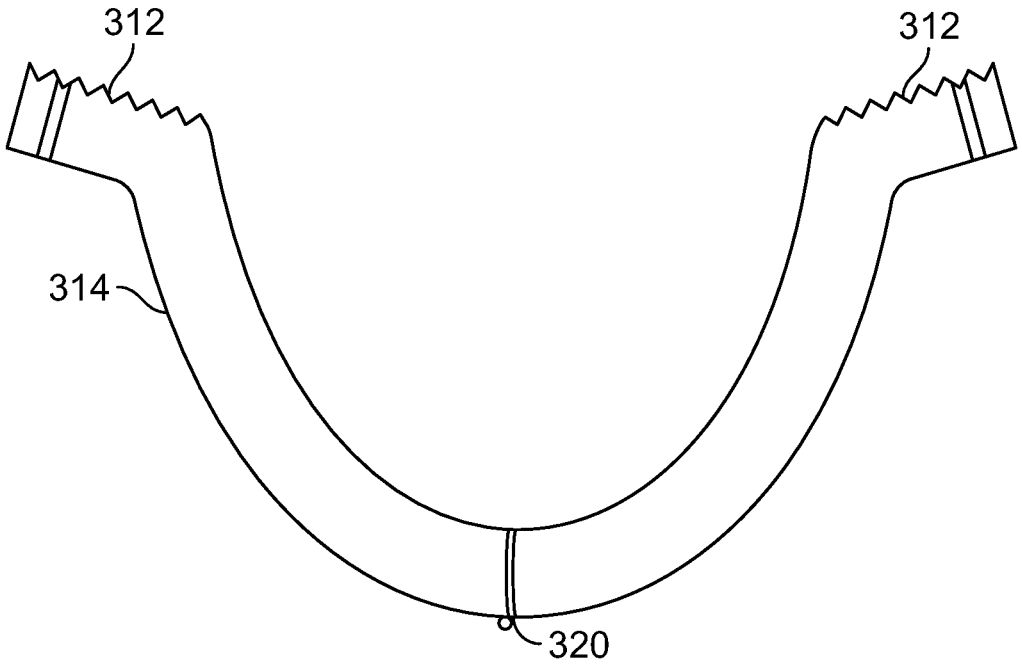
FIG. 3C is a side elevation view of a hinged saddle device used with the power module embodiment of FIG. 3B according to disclosed embodiments.

The embodiment of FIG. 3B further includes a hinged saddle 314 as depicted in more detail in FIG. 3C. The hinged saddle 314 is designed to couple and seal one or more connecting portions (e.g., windings) of the fluid circuit 310 of the connected system 100. The hinged saddle 314 can include a hinge 320 and one or more rigid clamping surfaces 312. The one or more rigid clamping surfaces 312 can be configured to couple to grooves of the connector 308. In some embodiments, any other suitable fasteners or couplings can be used for the one or more connecting portions.

In some embodiments, the piping or other exterior-facing aspects of the fluid circuit 310 can be covered, or partially covered, with the one or more solar panels 210 (e.g., an exterior of the pipe of the fluid circuit 310 wrapped in a flexible solar panel or an array of flexible solar panels, attached to a rigid solar panel or an array of rigid solar panels, coated with a solar film, etc.). Sizes, shapes, and a distribution of the one or more solar panels 210 covering or partially covering exterior portions of the fluid circuit 310 may vary depending on specific pipe and circuit dimensions.

Figure 4:
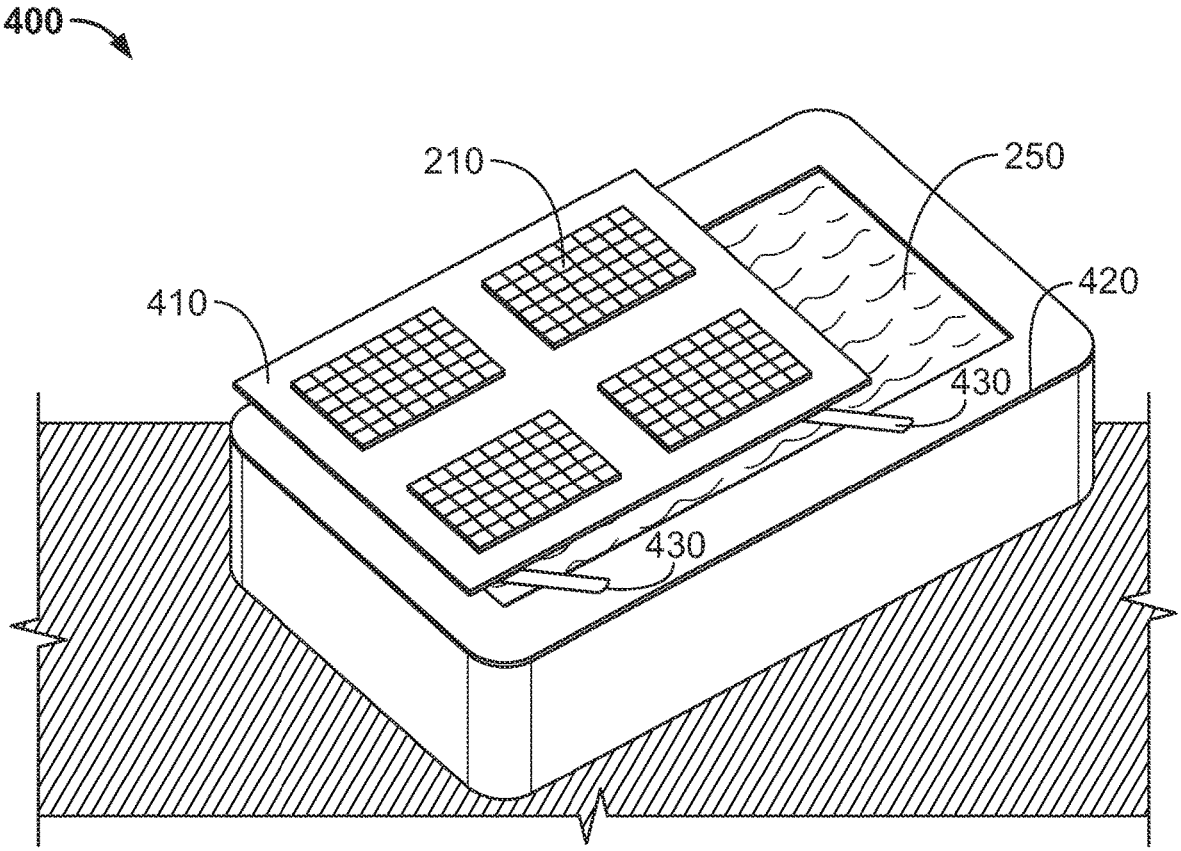
FIG. 4 is an isometric view of the power module of the connected aquatic system of FIG. 1 provided in the form of a solar pool cover according to disclosed embodiments.

FIG. 4 illustrates an embodiment of the power module 104 provided in the form of the solar panel cover system 400. In this embodiment, a cover 410 for an aquatic system 250 (e.g., a pool cover or spa cover) can be integrated with one or more solar panels 210. In some embodiments, the entire cover 410 or a portion of the cover 410 can be provided in the form of a solar panel 210, an array of solar panels, a flexible solar panel, an array of flexible solar panels, a solar film, a solar coating, or similar. In some embodiments, the cover 410 can be retrofitted with an array of solar panels 210. The solar panel cover system 400 can further include a retracting system 430 installed in or coupled to a deck 420 or similar surface surrounding the aquatic system 250, wherein the retracting system 430 opens and closes the pool cover 410. In some forms, the retracting system 430 can automatically, or substantially automatically, open and close the pool cover 410. In some aspects, the retracting system 430 can automatically open and close the pool cover 410 based on usage. In some embodiments, the solar panel cover system 400 can be connected to the controller 108, the solar controller 208, and/or the energy storage module 112, or a combination thereof. In some forms, the retracting system 430 can be provided in the form of hooks, wheels, locks, clasps, other fasteners, or other movable components.

In some embodiments, the controller 108 connected to the solar panel cover system 400 can perform the usage determination process 900 described in connection with FIG. 9 to open and close the solar panel cover system 400 automatically when the aquatic system 250 is not in use. In some embodiments, the solar panel cover system 400 may transform and directly transmit backup battery power or supplemental power to one or more peripheral devices 106 and/or system components 102. In some embodiments, the one or more solar panels 210 can be waterproofed. In some aspects, the one or more solar panels 210 can be provided with a booster to enhance energy harvesting capacity. Additionally, although one or more solar panels 210 are shown, it will be appreciated that other configurations, such as solar cell coatings, may be used within the solar panel cover system 400.

Figure 5:
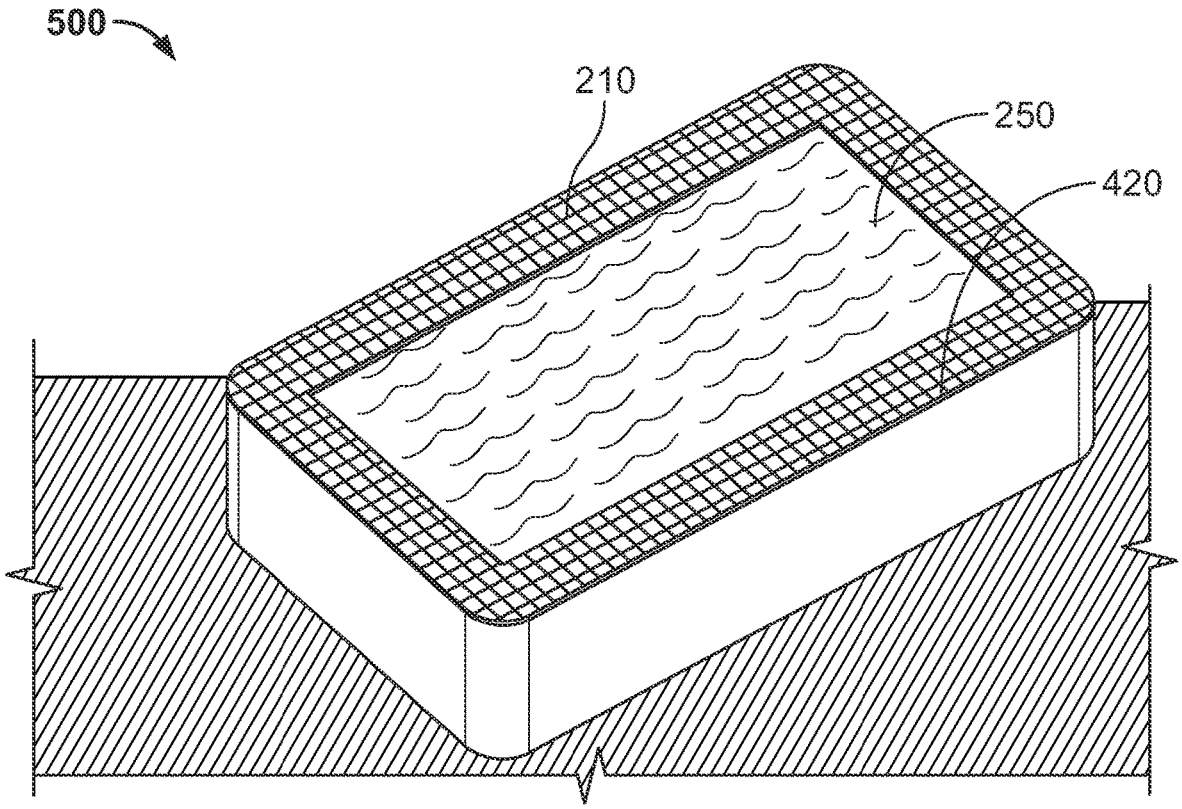
FIG. 5 is an isometric view of the power module of the connected aquatic system of FIG. 1 provided in the form of solar panel tiles according to disclosed embodiments.

FIG. 5 illustrates an embodiment of the power module 104 provided in the form of a solar panel deck system 500. In this embodiment, the deck 420 or any similar surface area surrounding the aquatic system 250 can include one or more power collection devices. In one embodiment, the deck 420 can include solar harvesting devices, such as tiles or pavers, with integrated solar panels 210. In some embodiments, the deck 420 can include kinetic energy harvesting devices, such as tiles or pavers, designed to collect and store energy from users (or animals) walking across the deck 420. In some embodiments, one or more surfaces of the aquatic system 250 (e.g., portions of the walls, floor, etc.) can include one or more solar panels 210, micro-electromechanical systems (MEMS), or any other types of power harvesting/collecting devices. The energy harvested and collected using the system 500 can be transformed and stored in the energy storage module 112. In some embodiments, the system 500 may transform and directly send backup battery power or supplemental power to one or more peripheral devices 106 and/or system components 102.

Although a deck 420 directly surrounding the aquatic system 250 is shown in FIG. 5, it will be appreciated that other configurations include, but are not limited to, solar panels installed in a patio, sidewalk, or other surfaces of the pool or spa area. In some embodiments, the one or more solar panels 210 can be waterproofed and/or can be provided with a booster to enhance energy harvesting. The one or more solar panels 210 can be installed and connected to the energy storage module 112 of the connected system 100 to collect and store energy collected from the system 500. Additionally, although one or more solar panels 210 are shown, it will be appreciated that other configurations, such as solar cell coatings, may be used within the solar panel deck system 500.

Figure 6:
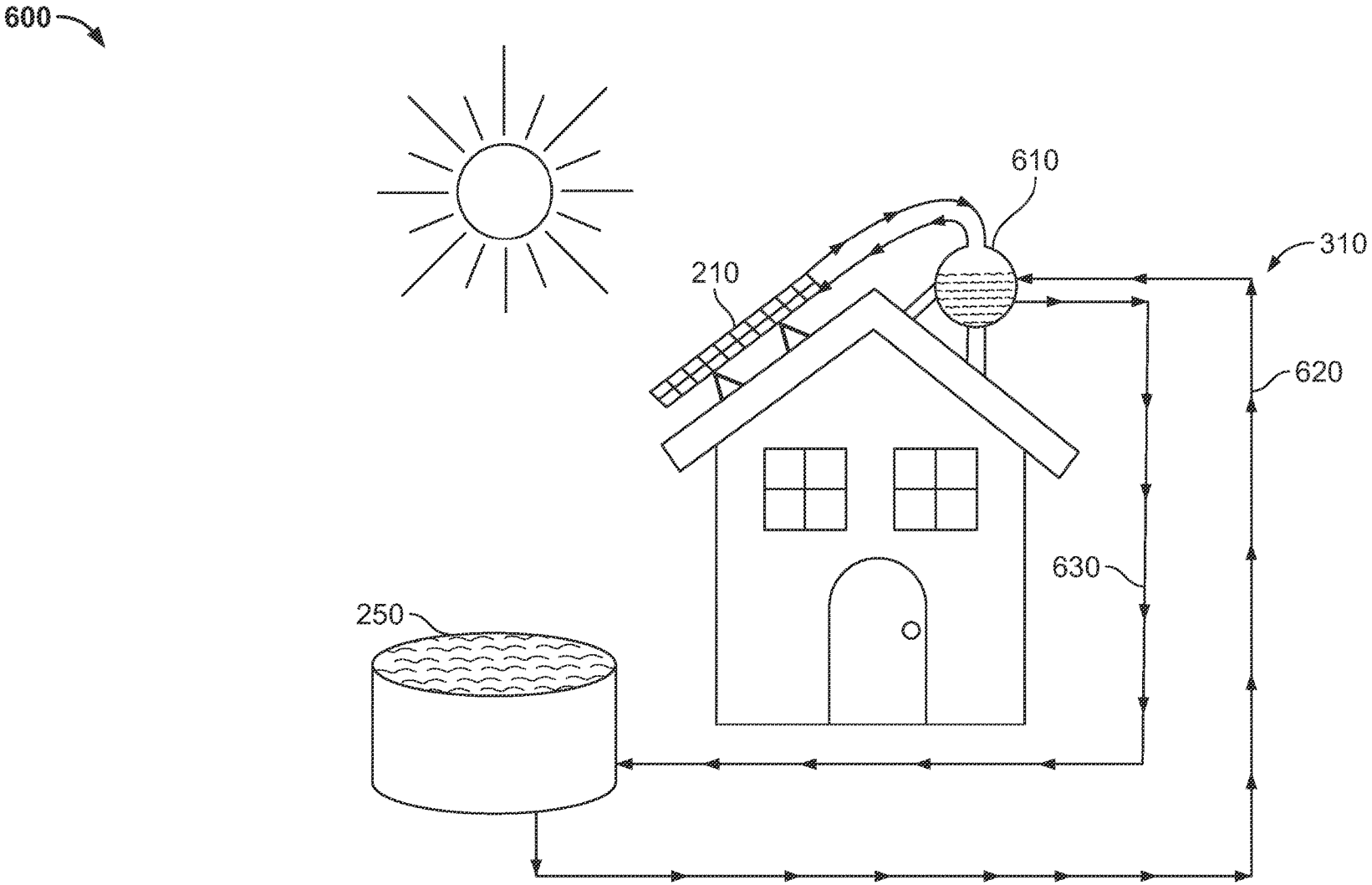
FIG. 6 is an illustrative diagram of the power module of the connected aquatic system of FIG. 1 provided in the form of a solar panel supercapacitor system according to disclosed embodiments.

FIG. 6 illustrates an embodiment of the power module 104 provided in the form of the solar panel supercapacitor system 600. In this embodiment, a roof-mounted solar panel 210 is installed with pipes of the fluid circuit 310 coupled to, or otherwise, in communication with, an underside of the solar panel 210 so that the solar energy harvested by the system 600 can be used to heat the water. The pipes can include an inlet 620 and an outlet 630, where the inlet 620 carries water that needs to be heated, and the outlet 630 carries heated water to the aquatic system 250. The system 600 cycles cold water from the aquatic system 250 (e.g., a pool or spa) to a reservoir 610 (e.g., a water tank) configured to hold heated water. The system 600 can further include one or more pumps and valves to facilitate the heating cycle. The reservoir 610 can be designed with heat collection, insulation, and an advanced magnification system to further increase water temperature and supplement the energy harvested from the solar panels 210. In some embodiments, the one or more solar panels 210 can be waterproofed and/or can be provided with a booster to enhance energy harvesting. In some embodiments, the reservoir 610 may be divided to contain both the heated water and the cold inlet water before it is heated. The reservoir 610 can also be mounted or otherwise installed on the roof of a home, on the ground, or in any other suitable location. In some aspects, one or more aspects of the system 600 can include one or more peripheral devices 106 (see FIG. 1).

In some embodiments, the system 600 can be provided in the form of an oil-filled system capable of heating the water to higher temperatures and is more compact compared to roof-mounted solar panels 210. An oil-filled radiator can be used instead of the reservoir 610 and is designed to be passive, mounted inside of a solar concentrator (e.g., a mirror array, a magnification system, or similar) on the roof in direct sunlight. Heated oil can be circulated to another heat exchanger (e.g., oil to water) where the water from the inlet 620 is passed through the heat exchanger and heated. The oil-filled system embodiment can further include a thermocouple and a blend valve to monitor and control the mix between the oil, the inlet 620, and the outlet 630, to regulate the water temperature and verify that the outlet 630 water returned to the aquatic system 250 is at the desired temperature. The oil-filled system further includes one or more valves 232 to control water flow to/from the aquatic system 250, a temperature sensor used to control the timing of opening and closing of the valves 232, and the controller 108 to perform logic functions, including where to divert the outlet 630 of heated water based on one or more factors, including a user's schedule and/or heating settings. In some embodiments, the system 600 can use any suitable non-volatile liquid or combination of fluids to heat the water to higher temperatures compared to standard solar panels. In some embodiments, the system 600 may transform and directly send backup battery power or supplemental power to one or more peripheral devices 106 and/or system components 102.

Figure 7:
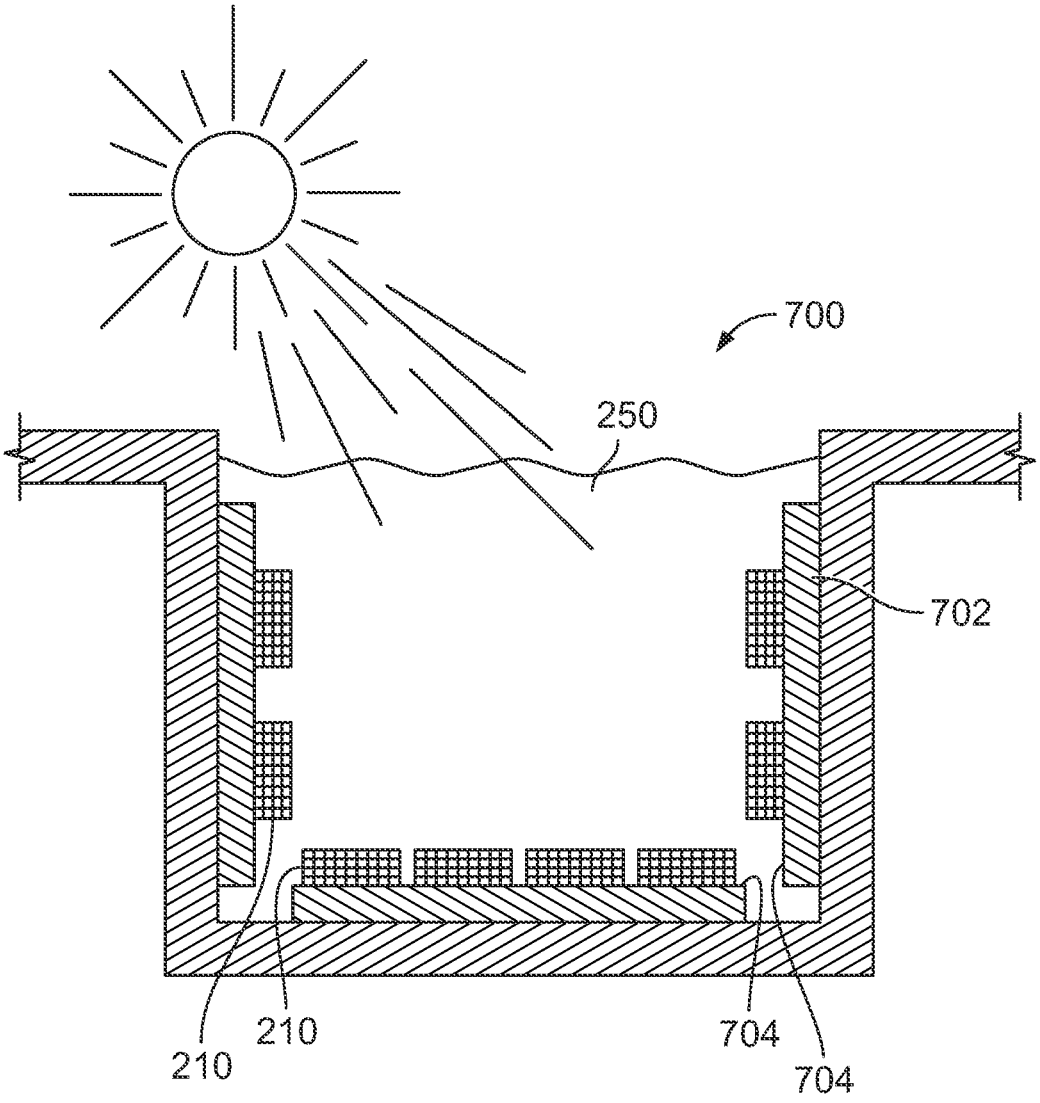
FIG. 7 is a partial cross-section view of a pool with the power module of the connected aquatic system of FIG. 1 provided in the form of a submerged solar panel system according to disclosed embodiments.

FIG. 7 illustrates a partial cross-section view of an embodiment of the power module 104 provided in the form of a submerged solar panel system 700 including surface coverings 704 for the one or more surfaces 702 of the aquatic system 250. In some embodiments, the surface coverings 704 can include one or more solar panels 210, an array of solar panels 210, or tiles having solar cell coatings that are arranged around a floor of the aquatic system 250 to mitigate the effect of light absorption by water. For example, the one or more solar panels 210 can be waterproofed and/or can be provided with a booster to enhance energy harvesting. Thus, the system 700 may facilitate thermal drift reduction/overheating and thereby boost the efficiency of the one or more solar panels 210. Additionally, each solar panel 210 may connect with a microinverter or bypass diode to mitigate the effect of shading in the aquatic system 250 area. The energy harvested and collected using the system 700 can be transformed and stored in the energy storage module 112 (see FIG. 1). In some embodiments, the system 700 may transform and directly send backup battery power or supplemental power to one or more peripheral devices 106 and/or system components 102.

One or more embodiments of the power module 104 can be used within the connected system 100 to power the system components 102. In one non-limiting embodiment, the power module 104 can include at least one turbine system (such as the inline turbine system 300 and/or the inline impeller system 305 as described with respect to FIGS. 3A-3C) integrated with or otherwise operatively coupled at least one solar energy harvesting system (such as the solar panel cover system 400, the solar panel deck system 500, the solar panel supercapacitor system 600, and/or the submerged solar panel system 700, as described with respect to FIGS. 4-7, respectively).

At least one solar energy harvesting system can supply a supplemental source of power while the turbine system can supply a main source of power. For example, the turbine system(s) can supply power to the high-powered system components 102 and energy storage module 112, while the solar energy harvesting system(s) can supply power to the low-powered and/or medium-powered system components 102 and energy storage module 112. In another example, the at least one turbine system can turn on or off based on a set point threshold value from the at least one solar energy harvesting system (e.g., if the at least one solar energy harvesting system can harvest at least a threshold level of energy sufficient to power the system components 102 and/or charge the energy storage module 112, then the at least one turbine system shuts off). In some embodiments, the set point threshold value is equal to a minimum startup voltage for a particular system component 102, while in other embodiments, the set point threshold value is equal to approximately 70% of the minimum startup voltage for a particular system component 102.

Figure 8:
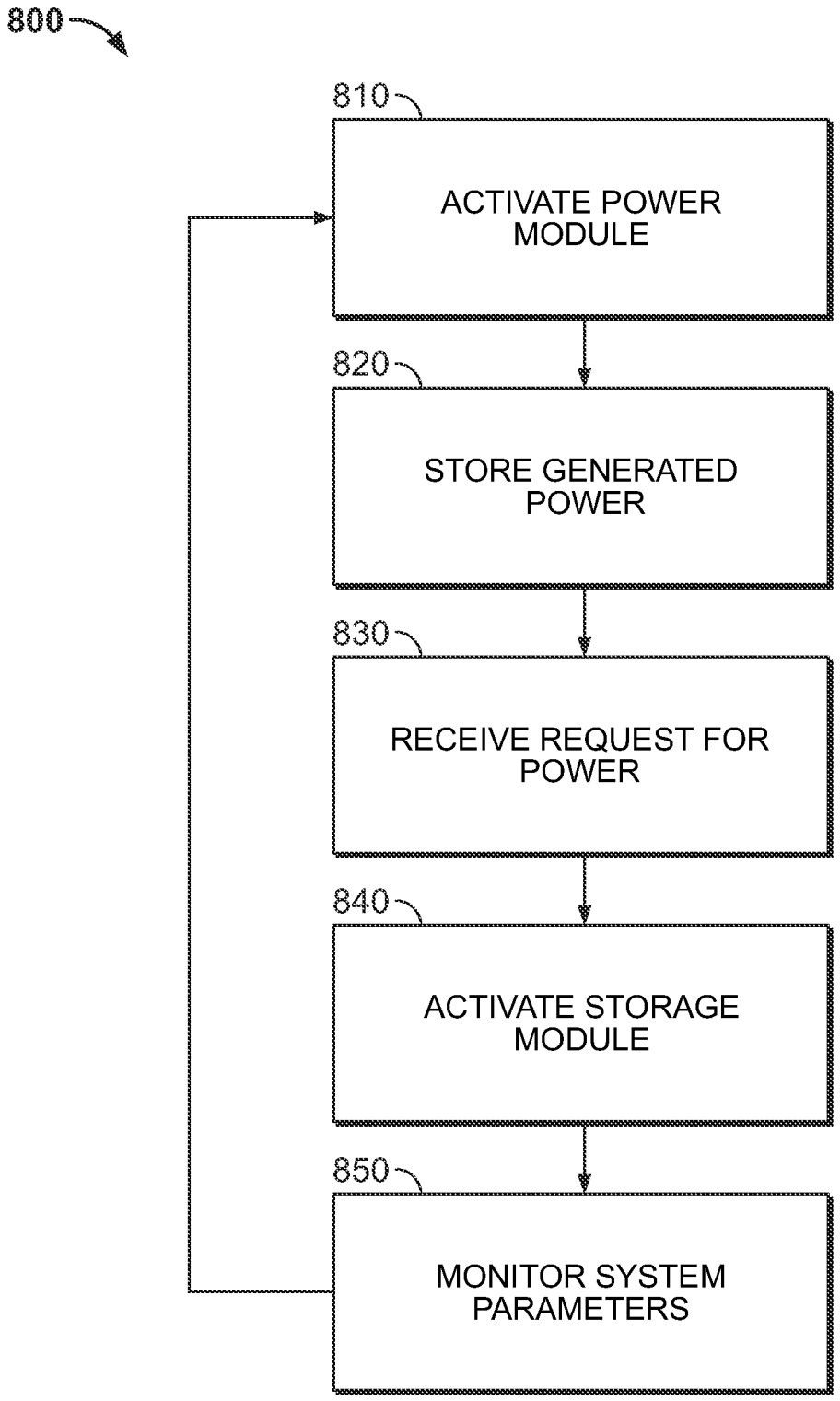
FIG. 8 is a flow diagram of a power harvesting process of the connected aquatic system of FIG. 1 according to disclosed embodiments.

FIG. 8 illustrates a power harvesting process 800 for harvesting, generating, or otherwise collecting energy using one or more power modules 104. At step 810, the power module 104 is activated. The activation can occur upon a triggering event, like a peripheral device 106 detecting sunshine, or the usage determination process 900 described in connection with FIG. 9, in two non-limiting examples.

At step 820, the energy harvested, generated, collected, or retrieved from the power module 104 can be stored in the energy storage module 112. The power may be transformed to be properly and efficiently stored in the one or more energy storage devices of the energy storage module 112.

At step 830, the energy storage module 112 can receive requests from the central controller 108, the one or more peripheral devices 106, and/or the system components 102. The requests can be provided in the form of low-power signals that may include information related to the type of device, including the power requirements, for the device requesting power. In some embodiments, the request receiving step 830 may be executed by the central controller 108 and/or the solar controller 208.

At step 840, the energy storage module 112 can be activated to send supplemental power to the requesting device in the form of stored energy from the one or more energy storage devices of the energy storage module 112. In some embodiments, the energy storage module 112 may transform the power using an inverter or similar device to accommodate the device type (e.g., DC vs. AC power). In some embodiments, the energy storage module 112 may provide only a portion of the requested power to the requesting device, based on a calculation of the power consumption of the requesting device and the expected run-time of the requesting device.

At step 850, the one or more peripheral devices 106 or other aspects of the connected system 100 can monitor one or more operating parameters of the connected system 100. In some embodiments, the monitoring step may occur continuously, substantially continuously, or only in response to an update signal being transmitted by the central controller 108.

Figure 9:
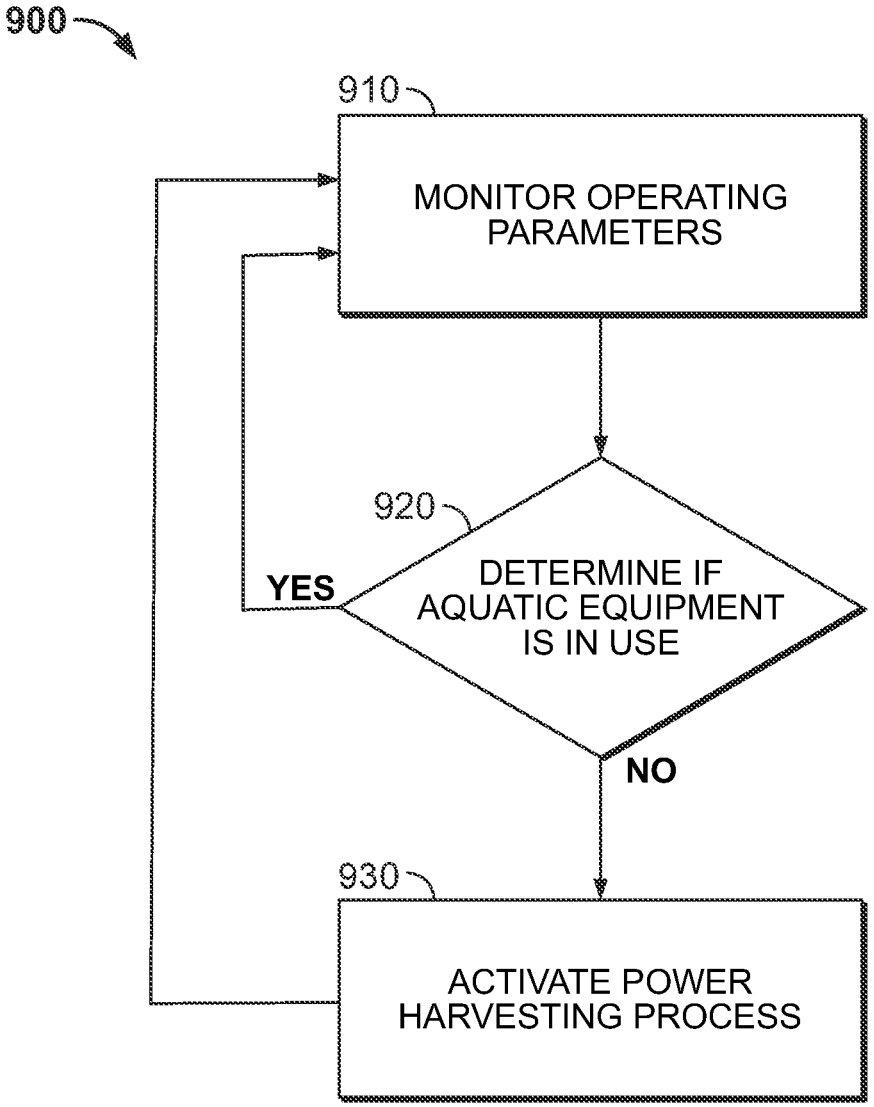
FIG. 9 is a flow diagram of a usage determination process of the connected aquatic system of FIG. 1 according to disclosed embodiments.

FIG. 9 illustrates a usage determination process 900 of the connected system 100 of FIG. 1. The usage determination process 900 is designed to detect when the aquatic system 250 is not in use and can be initiated to control and/or activate one or more aspects of the connected process. The usage determination process 900 can also be used to automatically, or substantially automatically, activate the power harvesting process 800 when the aquatic system 250 is not in use. At step 910, the connected system 100 monitors the operating parameters of the system components 102 or the aquatic system 250. In some embodiments, one or more peripheral devices 106 can be used to monitor the one or more operating parameters. In some embodiments, one or more motion-sensing devices can be used to determine when the aquatic system 250 is in use. In some embodiments, the motion-sensing device(s) may be integrated into the system components 102. In a non-limiting example, the pool lights 228 or the pool skimmer 224 can include motion-sensing devices used to monitor one or more operating parameters at step 910. In some embodiments, a thermal camera can be used to detect when one or more users are using the aquatic system 250. In some embodiments, a water level of the aquatic system 250 can be monitored, calculated, or otherwise measured to determine when the aquatic system 250 is in use.

The monitored operating parameters are processed and the controller 108, or another aspect of the connected system 100, determines at step 920 that the aquatic system 250 is not in use and can activate the power harvesting process 800. If the aquatic system 250 is determined to be in use at step 920, the usage determination process 900 can return to step 910 and continue monitoring the operating parameters until the process determines that the aquatic system 250 is not being used at step 920. Likewise, the usage determination process 900 can continue monitoring operating parameters at step 910 after the power harvesting process 800 is complete, or when the use of the aquatic system 250 is detected. Additionally, the operating parameters can continue to be monitored while the power harvesting process 800 is activated.

For example, if the controller 108 determines that the aquatic system 250 is not occupied by one or more users or is not being actively cleaned by the pool cleaner 222, the controller 108 can send a signal to the retracting system 430 (see FIG. 4) to close the pool cover 410 of the solar panel cover system 400, so that the solar panels 210 can harvest and collect solar energy when the aquatic system 250 is not in use.

In some embodiments, the connected system 100 can include an advanced training module, including a machine learning model or other advanced artificial intelligence-based process. The advanced training module can be integrated with or otherwise communicate with the controller 108, or other aspects of the connected system 100, to modify the operational parameters and/or activate the power harvesting process 800. In some embodiments, the advanced training module can automatically determine or retrieve weather data, geographical data, user data, usage data, schedule data, third-party applications, and other data sources to evaluate and determine an efficient power harvesting plan customized to the user's location and usage specifications.

In one non-limiting example, the advanced training module can decrease heating time by incorporating solar-powered heating elements in addition to the heater 212. In another example, if solar-heated water is not needed, because of the outside air temperature, for example, the solar-heated water stored in a reservoir 610 (or similar) can be routed and circulated to heat the water in the user's home. In some embodiments, a pump-to-heat water-to-water exchanger device (not shown) can be used to route and transform the solar-heated water for other applications.

In some embodiments, the advanced training module can be provided in the form of an intelligent automation system for monitoring and controlling the power module 104 and the energy storage module 112 using one or more controllers 108. For example, the intelligent automation system can monitor the amount of energy collected or harvested or otherwise collected with the power module 104, monitor a battery charge or power status related to the system components 102, and use the advanced training module to determine how long the connected system 100 can operate on existing energy stores in the energy storage module 112 and how much supplemental power is needed from the power module 104 based on one or more factors, including but not limited to the user's energy consumption, weather, historic energy consumption for the geographic region, and/or energy consumption by users (including in other areas) that exhibit similar usage patterns. In some embodiments, the intelligent automation system can include, among any other suitable additions/alternatives, a local mesh network and aggregating hub to relay data to the cloud, a user device 116, and/or a notification system 118.

In other embodiments, other configurations are possible. For example, those of skill in the art will recognize, according to the principles and concepts disclosed herein, that various combinations, sub-combinations, and substitutions of the components discussed above can provide appropriate control for a variety of different configurations of connected systems and computer architectures for control and management of power for aquatic equipment, and so on, for a variety of applications.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A system for monitoring and controlling power to one or more aspects of a connected aquatic system, comprising:

a first system component provided in a form of a pool device;

a first peripheral device operatively coupled to the first system component;

a power module operatively coupled to the first peripheral device;

an energy storage module operatively coupled to the power module, wherein the power module is configured to generate and transmit energy to be stored in the energy storage module; and a controller designed to execute programmable instructions including:

receiving an update from the first peripheral device that indicates a minimum power level of the first peripheral device; and based on receiving the update, providing energy from the energy storage module to the first peripheral device such that the minimum power level is met, wherein the power module is provided in the form of a turbine system, and the turbine system is installed within the first system component.

2. The system of claim 1, wherein the power module is provided in the form of a solar energy harvesting system.

3. The system of claim 2, wherein the solar energy harvesting system is provided in the form of one or more solar panels and a solar panel controller.

4. The system of claim 1, wherein the energy storage module includes one or more of a capacitor bank, a battery bank, a rechargeable battery, a solar battery, and a supercapacitor.

5. The system of claim 1, wherein the controller transmits alerts to a user device when the first peripheral device is using supplemental power from one or more of the power module and the energy storage module.

6. The system of claim 1, wherein the turbine system includes an impeller device.

7. The system of claim 1, wherein the controller is designed to execute further programmable instructions comprising:

receiving an update from the first system component that indicates a minimum power level of the first system component; and based on receiving the update, providing the energy from the energy storage module to the first system component such that the minimum power level is met.

8. A system for monitoring and controlling power to one or more components of a smart aquatic system, comprising:

a first system component;

a power module designed to collect energy, the power module further comprising a solar energy harvesting system;

an energy storage module operatively coupled to the power module; and a controller designed to execute programmable instructions including:

measuring an amount of energy collected from the solar energy harvesting system;

determining whether the amount of energy is sufficient to power the first system component based on a set point threshold value of the first system component;

activating the power module to collect supplementary energy based on whether the set point threshold value is met;

connecting the energy storage module to the power module to receive the energy; and providing the energy from the energy storage module to the first system component.

9. The system of claim 8, wherein the solar energy harvesting system is provided in a form of a solar panel cover system.

10. The system of claim 8, wherein the solar energy harvesting system is provided in a form of a solar panel deck system.

11. The system of claim 8, wherein the solar energy harvesting system is provided in a form of a solar panel supercapacitor system.

12. The system of claim 8, wherein the solar energy harvesting system is provided in a form of a submerged solar panel system.

13. The system of claim 8, wherein the power module includes a turbine system, wherein the turbine system is installed within a second system component provided in a form of an aquatic system pump.

14. The system of claim 8, wherein the controller is designed to execute further programmable instructions comprising:

receiving an update from the first system component that indicates a minimum power level of the first system component; and based on receiving the update, providing the energy from the energy storage module to the first system component such that the minimum power level is met.

15. A method for monitoring and controlling power to one or more components of a smart aquatic system, comprising steps of:

providing an aquatic system, the aquatic system comprising one or more system components, one or more peripheral devices, a power module, an energy storage module operatively coupled to the power module, a controller, a database, and a network;

activating the power module to harvest energy;

storing the energy in the energy storage module;

receiving a request for the energy from the one or more system components or the one or more peripheral devices; and activating the energy storage module to send the energy to the one or more system components or the one or more peripheral devices.

16. The method of claim 15, further comprising monitoring one or more operating parameters of the aquatic system.

17. The method of claim 16, wherein the step of monitoring one or more operating parameters of the aquatic system is performed by the one or more peripheral devices.

18. The method of claim 16, wherein the smart aquatic system further comprises a user device and a notification system.

19. The method of claim 18, further comprising displaying the one or more operating parameters on the user device via the notification system.

20. The method of claim 19, further comprising receiving user input from the user device to adjust the one or more operating parameters.

* * * * *